United States Patent [19]

Seragnoli

[11] 3,968,627

[45] July 13, 1976

[54] TWIST FINGER DEVICE FOR A CANDY WRAPPING MACHINE

[75] Inventor: Enzo Seragnoli, Bologna, Italy

[73] Assignee: G. D. Societa per Azioni, Italy

[22] Filed: Dec. 2, 1974

[21] Appl. No.: 528,663

[30] Foreign Application Priority Data

Dec. 20, 1973 Italy ..... 3545/73

[52] U.S. Cl. ..... 53/370

[51] Int. Cl.[2] ..... B65B 7/12

[58] Field of Search ..... 53/181, 370, 228, 233, 53/232, 234, 181, 37 D

[56] References Cited

UNITED STATES PATENTS 3,279,149 10/1966 Latini et al. ..... 53/370

FOREIGN PATENTS OR APPLICATIONS 551,967 11/1956 Italy ..... 53/370

1,185,244 3/1970 United Kingdom ..... 53/370

*Primary Examiner*—Othell M. Simpson
*Assistant Examiner*—Leon Gilden
*Attorney, Agent, or Firm*—Robert E. Burns; Emmanuel J. Lobato; Bruce L. Adams

[57] ABSTRACT

A device to be mounted on a wrapping machine to fashion the wrap on candies or similar products in "single end" or "double end" twist styles of wrap. An axially sliding sleeve has a pair of twist fingers symmetricaly pivoted to one of its ends. A rod slides in an axial direction in the inside of the sleeve for opening and clising the fingers. Gear means are provided for causing the sleeve and the rod to rotate in unison, and for cooperation with a pair of gears for sliding the sleeve and rod. One of the gears of this pair is mounted rotatably and slidably on the rod; the other is mounted rotatably but non-slidingly on the sleeve. The gears of this pair have inclined web structures. In conjunction with fixed guide rollers they operate the rod so that it is given a reciprocating movement with respect to the sleeve.

One gear in each pair is connected to the said gear means that cause the sleeve and the rod to rotate in unison, whilst the other, mounted in a rotatable but non-sliding way on the sleeve, rotates and slides in contrast with the aforementioned flexible means on the rod. The gears mentioned last, structured in their plane of rotation, are helical and behave like a front type cam, so as to operate, in conjunction with the fixed guide and support pressure means, the said rod so that it is given a flexible movement with respect to the sleeve and both the said sleeve and the said rod jointly with a reciprocating movement.

On the said device the fingers of the twist finger assemblies are operated without the aid of cams and levers; thus the said device can be used in conjunction with very high unit output speed wrapping machines producing something in the region of a thousand and more wrapped products per minute.

11 Claims, 6 Drawing Figures

Fig.4
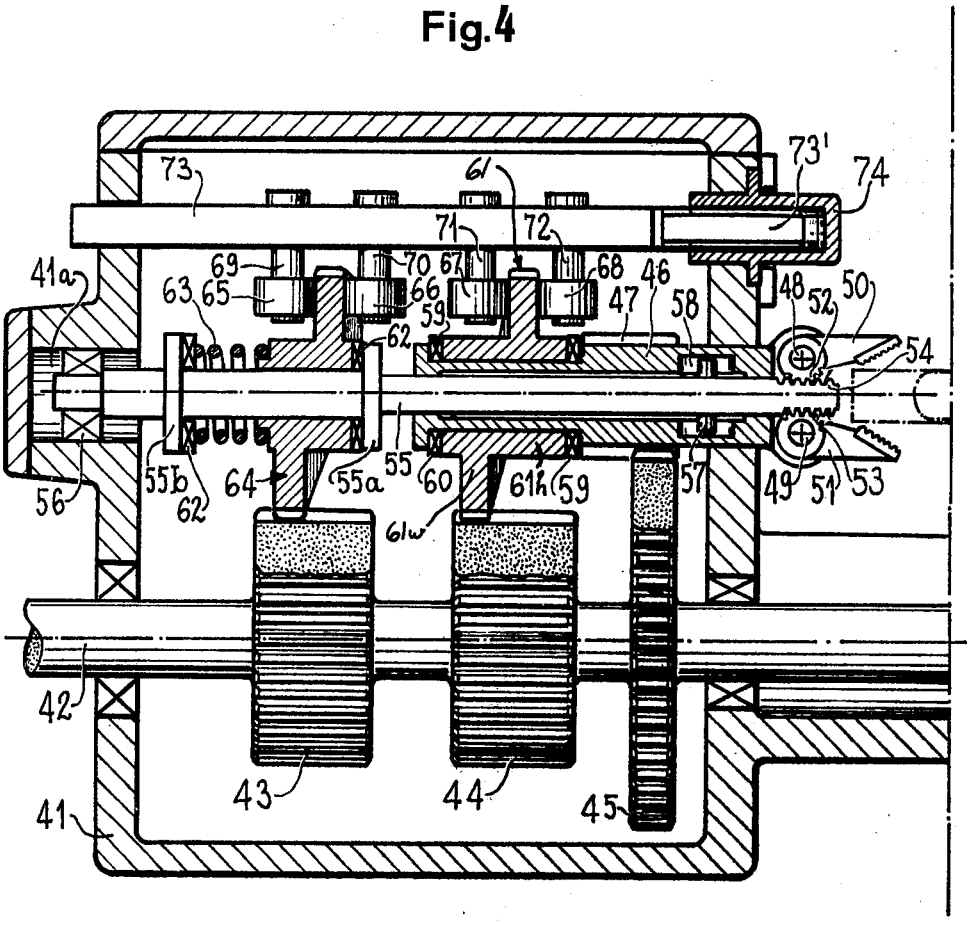
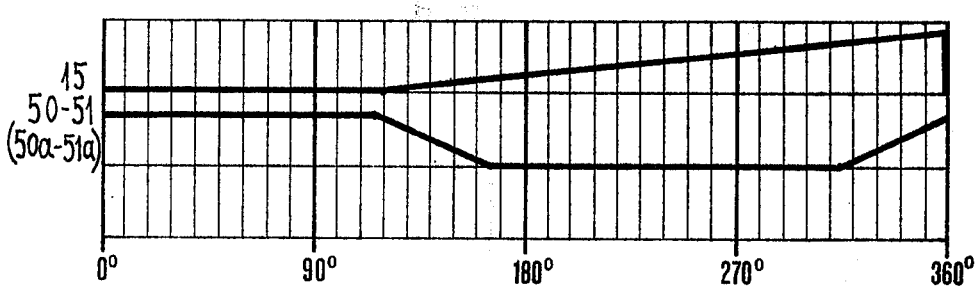
Fig.5

TWIST FINGER DEVICE FOR A CANDY WRAPPING MACHINE

BACKGROUND OF THE INVENTION

This invention relates to a twist-finger device to be mounted on a machine for wrapping candies or similar products to fashion the wrap in what is known as the 'single end' ('side bow') or 'double end' twist styles of wrap.

DESCRIPTION OF THE PRIOR ART

With machines for wrapping candies or similar products, the method is already used of creating a tubular wrap around the product to be wrapped and of having folding mechanism at the opposite ends of the tubular wrap with which to fashion it into the desired style: for example, the 'single end twist' ('side bow') style, the 'double end twist' style and in other styles too.

In the particular case of what are called the 'single end twist' ('side bow') and the 'double end twist' styles of wrap, the use is known of what are called twist finger assemblies positioned along the wrapping track of the wrapping machine. Each of them, when brought into operation, grasps the opposite end of the tubular wrap, rotates around its axis which generally coincides with that of the tubular wrap, and simultaneously moves closer to the product because of the wrap having got shorter as a result of the twist given to the end.

On all the devices of this type known to date, the twist finger assemblies are made to open their fingers to grasp the end of the tubular wrap, and to progressively move closer to the product and return to their original condition, by means of cams keyed onto one single drive shaft and levers associated to the cams, or through toggle lever systems which operate the various parts, see for example, British Pat. Nos. 442,803 and 699,422, German Pat. Nos. 650,533 and 885,227 and Italian Pat. No. 466,665.

SUMMARY OF THE INVENTION

The object of the present invention is to provide a device of the type mentioned above for operating the fingers of the twist finger assemblies so that they suit the purpose and the function mentioned above, which are designed in a very simple way without any such lever systems being used since these, on account of their constructional nature have, as is known, operating limits that are below the production speed limits now achievable on wrapping machines of, for example, the type described in British Pat. No. 1,259,912 and in Italian Pat. No. 862,104.

The subject of the present invention is, in fact, a device for mounting on wrapping machines to fashion the wrap on candies or similar products in either the 'single end' ('side bow') or the 'double end' twist style of wrap. The device comprises at least one twist finger assembly comprising: an axially sliding sleeve; a pair of twist fingers symmetrically pivoted to one end of this sleeve; a rod that also slides in an axial direction, in the inside of the sleeve, through which the opening and closing of the fingers is actuated; resilient means interposed between the aforementioned sleeve and the rod; and gear means for causing the sleeve and the rod to rotate in unison. According to the invention the device comprises a pair of gears for each pair of twist fingers. One of the latter gears is connected to the gear of the gear means that causes the sleeve and the rod to rotate in unison. The other gear in the pair is mounted on the sleeve, and causes sliding of the latter against the reaction of the aforementioned resilient means on the rod. Each gear of the pair has an inclined web, and is engaged by rollers on a fixed guide, so that rotation of the gear means resilient resilieint reciprocating movement of the rod with respect to the sleeve as well as a reciprocating movement of the sleeve and rod jointly.

BRIEF DESCRIPTION OF THE DRAWINGS

In the accompanying drawings:

FIG. 4 shows a part of the new device in a vertical sectional view;

FIG. 5 shows the phase time graph in respect of the wrapping head of the machine and of the fingers of the twist finger device in question;

DESCRIPTION OF THE PREFERRED EMBODIMENT

The device depicted is mounted on a machine of the type described in Italian Pat. No. 862,104 of the assignees hereof. Out of a continuous supple candy rope, the machine forms the individual pieces of candy and then wraps them.

In the description that follows, mention is only made of the parts of the patented machine directly affected by the device forming the subject of the present invention.

Figure 2:
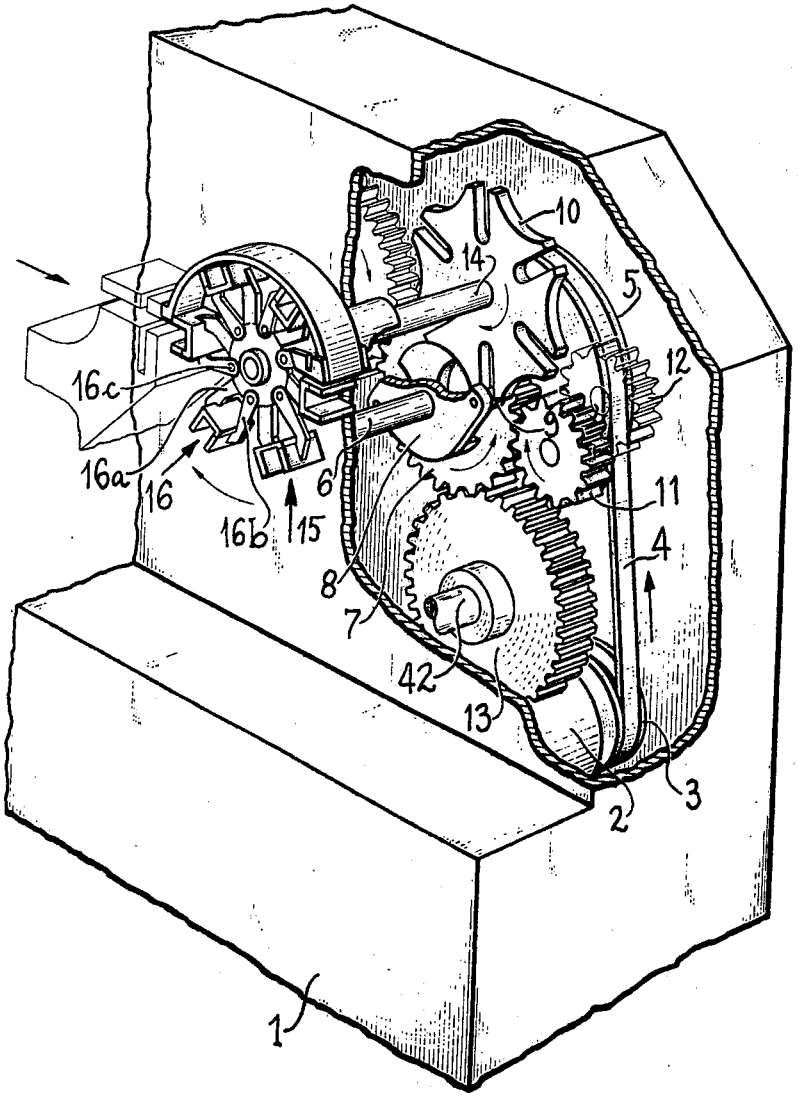
FIG. 2 shows, in a perspective view, a part of the machine illustrated in FIG. 1, with certain parts removed.

With reference, therefore, to the above mentioned figures, at 1 there is the fixed casing of the machine and at 2 an electric motor which constitutes the source of prime movement (see FIG. 2).

The shaft of the motor 2 has keyed to it a pulley 3 which, through a belt 4, carries in rotation a pulley 5.

On a shaft 6 of the pulley are mounted a gearwheel 7 and a rhomb shaped cam 8. The latter is provided in opposite positions with a pair of idle rollers 9 which cyclically and successively engage with the radial slots in a Geneva mechanism 10.

The gearwheel 7 carries in rotation a gear 13.

As has been said, the rhomb shaped cam 8, which rotates with a uniform motion, carries in intermittent rotation the Geneva mechanism 10 and thus the shaft 14 of this is also carried in intermittent rotation.

In the form of embodiment illustrated, this shaft halts in its rotation at each sixth of a revolution, that is to say, each time the gearwheel 7 completes half a revolution.

Ridigly mounted on the shaft 14 there is a wheel 15 with radial grippers 16 and thus the intermittent rotatory motion given to the shaft 14 is passed on to the wheel.

In the example illustrated, the wheel 15 is provided with six radial grippers, each of which consists of a fixed jaw **16*a* and a jaw 16*b* that oscillates around a pin 16*c*** fixed to the hub of the wheel.

Figure 1:
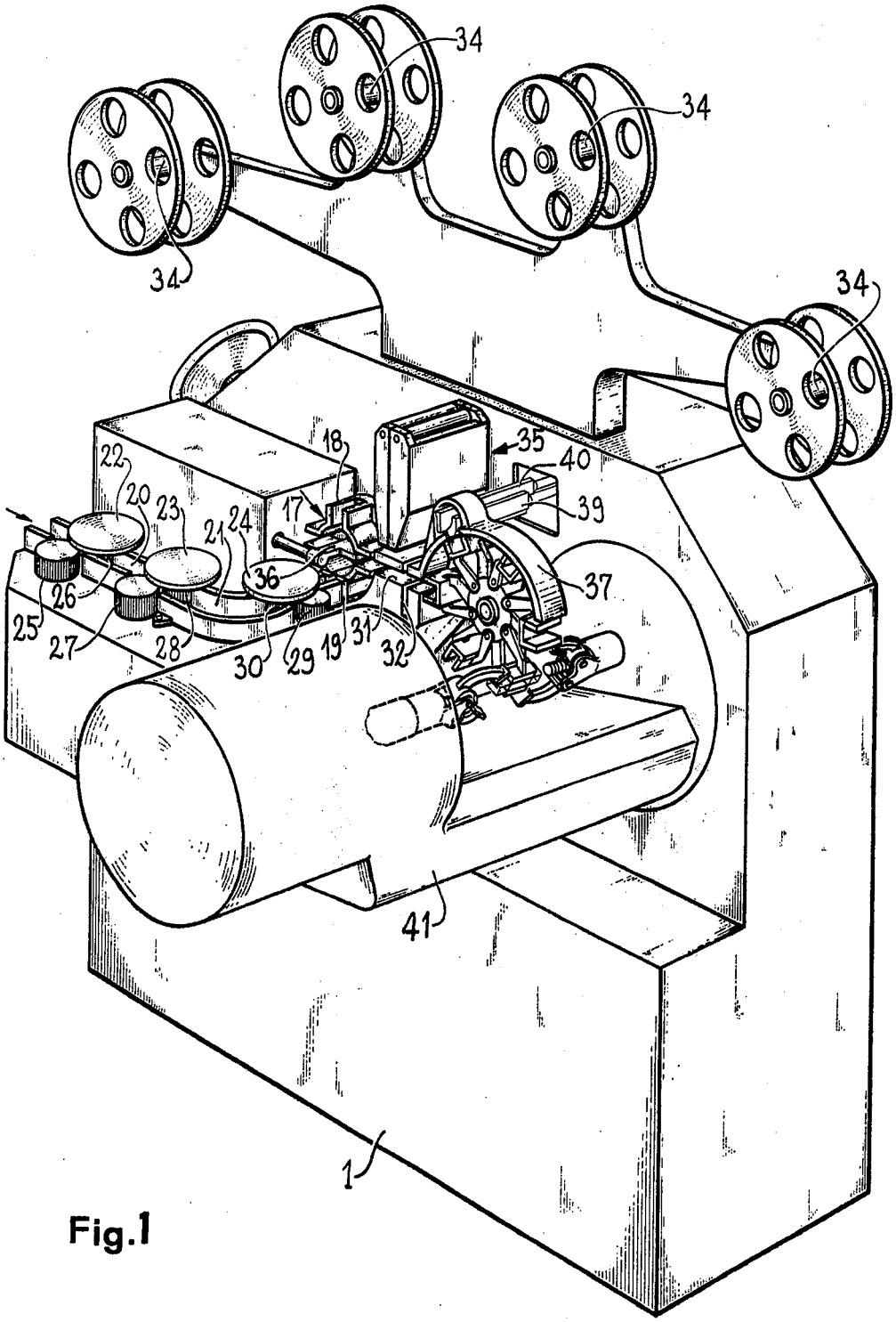
FIG. 1 shows diagrammatically, in a perspective view, a wrapping machine provided with the twist finger device according to the invention.

At 17, see FIG. 1, there is a wheel with radial pockets 18, each of which houses one piece of candy. At 19 there is a cutting device which cuts the individual pieces of candy off a continuous rope.

The cutting device operates in the immediate vicinity of the wheel 17, on a plane perpendicular with the shaft of the wheel and it consists of two jaws pivoted at a common point, which have cutting profiles at one end.

A channel 20 is delimitated by two vertical parallel walls (see FIG. 1).

A continuous supple candy rope is placed therein and while moving along its longitudinal extension is progressively roughed and formed until it develops a section corresponding to that of the candy.

A first halting station for the pockets 18 of the wheel 17 can be considered to be the one where each pocket 18 is positioned by the outlet point from the channel 20 (in FIG. 1 this corresponds to the lowest position in which the pockets 18 can go). A second halting station can be considered to be the one where the pockets are successively aligned with and positioned by the grippers 16 of the wheel 15 (in FIG. 1 this station is displaced 90° counter clockwise with respect to the previous station).

Likewise a first halting station for the grippers 16 of the wheel 15 can be considered to be the one where each pair of grippers halts aligned with and positioned by one of the pockets 18 of the wheel 17 at a standstill in the said second station of the wheel 17. In the example illustrated, a second halting station for the grippers 16 of the wheel 15 can be considered to be the one where the product is ejected, as will be seen a little later on in this text.

The channel 20 extends up to a point corresponding to where the first halting station of the pockets 18 is located so that the pieces of candy can be inserted directly therein.

In the proximity of its outlet, the channel undergoes a curvature 21 (see FIG. 1) in which there is a larger cross section to allow it to serve as a storage lung or compensation chamber.

The sides and underneath part of the candy rope are progressively shaped by the parallel walls of the channel and by its base, respectively, while the upper part is sized by sizing disks located above the said channel and numbered 22, 23 and 24.

The candy rope is made to move forward inside the channel by the pairs of drive rollers 25–26, 27–28 and 29–30.

It should immediately be made clear that the forward motion of the candy rope proceeds in a uniform way along the channel 20, up as far as the curvature 21 but that from the drive rollers 29–30 onwards it takes place intermittently.

For this reason, while the pair of rollers 25–26 and the pair 27–28 rotate in a uniform fashion, the rollers 29–30 rotate with an intermittent motion.

The intermittent rotatory movement of the wheels 15 and 17, which in the form of embodiment described herein are provided with six grippers 16 and four pockets 18 equidistantly spaced away from one another on their respective wheels, takes place in such a way that each time they come to a halt, successive pockets 18 of the wheel 17, at a standstill in the second station, and successive grippers 16 of the wheel 15, at a standstill in the first station, find themselves aligned with one another.

Thus between two successive stops, the wheel 17 defines a counter clockwise arc of 90° and the wheel 15 one of 60° in a clockwise direction.

The second station of the wheel 17 and the first station of the wheel 15 are linked through a guide 31 (see FIGS. 1 and 6) determined by two parallel superposed surfaces. This guide has a vertical slit 32 running across it and this used to infeed, transversely with respect to the guide, successive pieces of wrapping material 33 (see FIG. 6) supplied, for example, from reels not depicted on the drawings, mounted on reel carrier arbors 34. Conveyed by devices which in themselves are known, as shown diagrammatically at 35 in FIG. 1, the pieces of wrapping material, which arrive intermittently in step with the delivery of the succession of pieces of candy, intersect the guide 31.

The pieces of candy, cut by the cutting device 19, are inserted in the pockets 18 as they present themselves one after the other at the first station and when they reach the second station they are driven into guide 31 by a pusher member 36 which is operated with a to-and-fro motion.

As previously stated, the jaws **16*b* of the grippers 16 of the wheel 15 are pivoted at 16*c* to the hub of the wheel and are made to oscillate in a reciprocating fashion. To be more precise, the grippers have to remain closed while the wheel 15 is in motion, so that the jaws 16*b*, together with the cooperating jaws 16*a*, be held against the candies being transferred and that, at points corresponding to where the wheel 15 makes other halts, the jaws 16*b* part from the cooperating jaws 16*a***, once to allow candies to be inserted into the said grippers, then for various wrapping operations to be carried out and finally for the candies to be extracted upon completion of their transfer.

At 37 (see FIGS. 1 and 6) there is a cylindrical wall or profile closely surrounding to the rotatory path followed by the grippers 16 and in this, at a point corresponding to where an intermediate station is located below the first station of the grippers, there is an aperture 38.

Two oscillating contrivances operate at a point corresponding to where the aperture 38 in and these, 39 and 40, respectively, for the sheet 33 into a tubular wrap around the product being wrapped.

The clutching extremities of the grippers 16 are so fashioned (see FIG. 6) that they form, when the grippers are closed, a U with complementary sections **16*d* and 16*e*** along one of the prongs of the said U.

The part shown as **16*d* comprises one of the prongs, as well as the bottom and a small section of the other prong of the U, while the part shown as 16*e*** comprises the remainder of the other prong.

Figure 3:
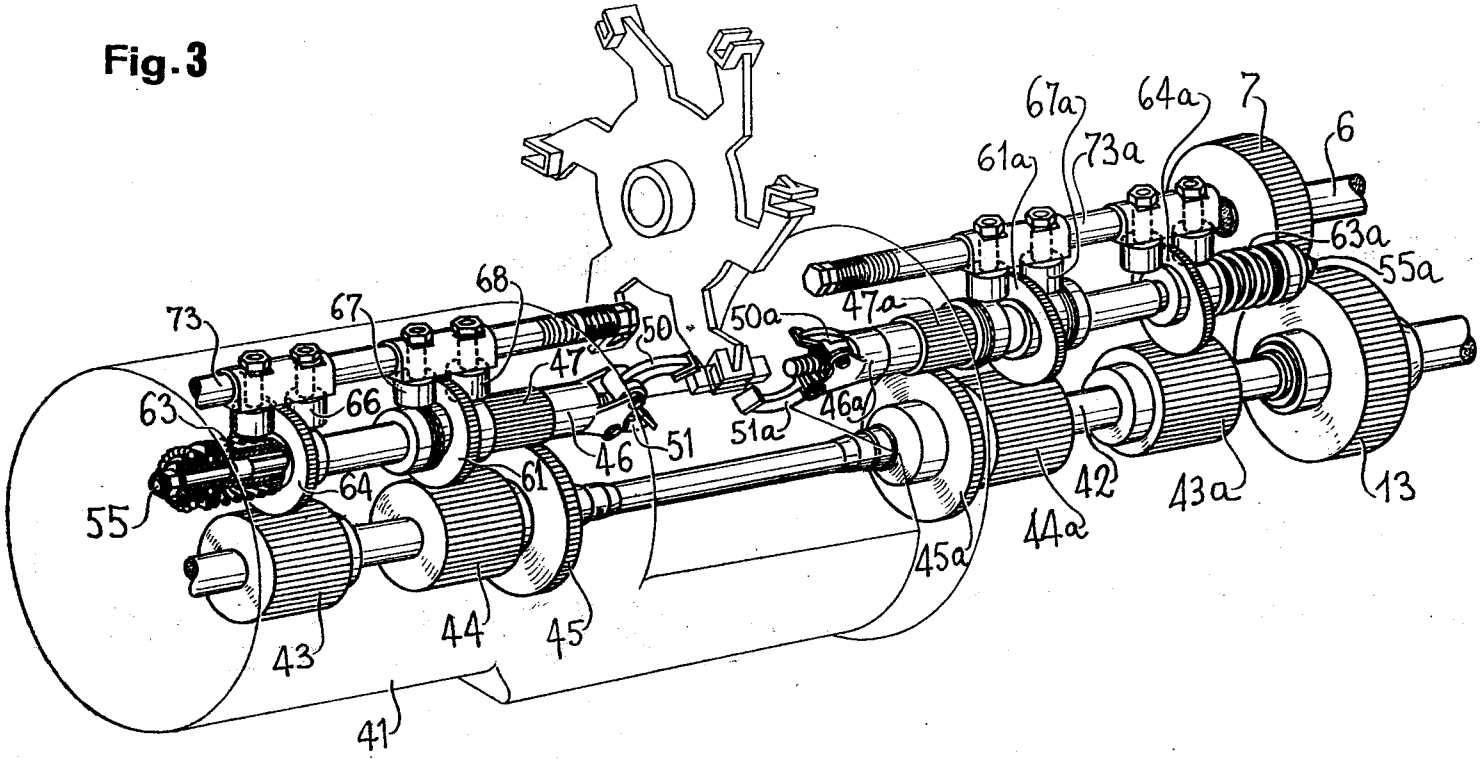
FIG. 3 shows diagrammatically, in an external perspective view, a preferred embodiment of the new device.

FIG. 3 diagrammatically shows the twist finger device according to the invention in its version for fashioning the wrap in what is known as the 'double end twist' style, that is to say, the device consists of two groups of parts symmetrical with respect to the plane of the wrapping line formed by the intermittently rotatable head 15. FIG. 4 shows in vertical sectional form one of these groups needed to fashion the wrap of the product into the 'single end twist' ('side bow') wrapping style.

The description that follows is referred to one only of these or groups since the other that is placed symmetrically to it is identical. For this reason the same or corresponding parts are shown in FIGS. 1 and 3 just with a number for the group being described and with the same number followed by a small letter *a* for the other symmetrical group.

The twist finger device is mounted in an easily interchangeable way on the wrapping machine, see FIG. 1. It is housed in a casing 41 which can be secured in a known way to the frame 1 of the machine and it is driven by the gearwheel 7 of the machine through the continuously rotating gear 13 (see FIGS. 2 and 3). The gear 13 is keyed to a shaft 42 supported rotatably in the inside of the casing 41. Furthermore, on the shaft 42 are rigidly mounted in a symmetrical position with respect to the plane of the wrapping wheel 15, two groups of three driving gears 43, 44, 45 and 43*a*, 44*a*, 45*a* (see FIG. 3). The parts of the device that really constitute the twist fingers are supported by the casing 41 parallel with the shaft 42 and in a location corresponding to where the gears 43, 44, 45 and 43*a*, 44*a*, 45*a* are positioned. Each of the twist finger parts consists of a sleeve 46 rotatable around its shaft and provided with external toothing or driven gear portion 47 meshing with that on the gear 45, for.

To one extremity of the sleeve 46, outside the casing 41 are pivoted at 48 and 49 the twist fingers 50 and 51. They are provided with segmental gear racks 52 and 53 concentric with the pivots 48 and 49, respectively. The racks 52 and 53 mesh with a rack 54 on the end of a rod 55 carried coaxially inside the sleeve 46, the other extremity of which rod extends beyond the sleeve 46 where it is supported by a ball bearing 56 sliding in a cylindrical guide 41*r* in the casing 41. The rod 55 is carried in rotation with the sleeve 46 through a drive member or pin 57, and it slides axially with respect to the sleeve 46, as the drive pin 57 engages with longitudinal grooves 58 radially extending into the inside of the sleeve.

Rotatably mounted directly on a recessed portion of sleeve 46, in a non-sliding fashion, with the aid of thrust bearings 59 and shoulders 60, there is a a cylindrical hub 61*h* of a driven spur gear 61 that meshes with the driving gear 44 keyed to the shaft 42, for a rotation of the driven gear which is slower than that of the driven gear portion 47 and sleeve 46. Also rotatably mounted directly on rod 53, but with the possibility of sliding axially between shoulders 55*a* and 55*b* and with the interposition of thrust bearings 62 and a return spring 63, there is a cylindrical hub 64*h* of a driven spur gear 64 that meshes with the driving gear 43 keyed to the aforementioned shaft 42. The driven gears 61 and 64 are of mutually similar form and size, each having a web 61*a*, 64*w* inclined to the axis of the sleeve. A circumferential part of each gear 61, 64 and, as shown, of its inclined web, constitutes a front type cam. On opposite sides of each gear 61 and 64, in the proximity of their toothed periphery, and arranged in contact with them, are cam-engaging rollers 65–66 and 67–68, respectively. These are loosely mounted on pins 69–70 and 71–72, respectively. The pins, in turn, are secured to a bar 73 one end of which is carried in a slidable non-rotatable fashion by the casing 41. The other end of the bar constitutes a screw 73' on to which is screwed a female thread of a sleeve 74 carried in a non-sliding rotatable fashion by the casing 41 in such a way that it be possible to rigidly secure, subject to axial adjustment the position of the bar 73 and consequently that also of the idle rollers the bar carries in housing 41, to suit the dimensions of the product to be wrapped, as will be seen hereinafter.

A description will now be given of the way in which the device according to the invention operates.

The continuous supple candy rope is made to enter in the channel 20 where, under the driving action of the pairs of rollers 25–26 and 27–28, it moves forward with a uniform motion. Simultaneously the sizing disks 22 and 23, together with the base and the vertical walls of the channel 20, give the rope a cross section which progressively becomes more and more like that of the candies to be produced and ends up by being identical thereto.

On the other side of the larger section curvature 21, the continuous rope is, instead, intermittently moved forward by the pair of rollers 29–30, while the disk 24 completes the sizing operation. It can, therefore, be understood that since the uniform motion rotation speed of the drive rollers and the intermittent motion rotation speed of the drive means is chosen in an interdependent way, the speed at which the candy rope is moved forward by the intermittently rotating rollers can be considered as wavering around a mean value coinciding with the actual speed at which the rope moves forward.

The larger section curvature 21 constitutes a sort of lung or compensation chamber where, in time with the intermittent rotation of the rollers 29–30, the excess material accumulated each half cycle can be stored ready to be disposed of in the subsequent half cycle. It thus ensues that past the rollers 29–30 the rope moves forward with an intermittent motion and that in time with this motion, the cutting profiles of the cutting device 19 cut a succession of pieces of candy C off the rope. The rope at the rear of the cut pieces pushes them into whichever one of the pockets 18 happens to be at a point corresponding to where the first halting station of the wheel 17 is positioned.

Let us now follow one individual piece of candy as it goes through all the wrapping operations; as can be understood, all subsequent pieces of candy are subjected to the self same sequence of operations and each piece is one step behind the one preceding it.

Once the piece of candy C has been inserted inside the pocket 18 at a standstill in the first halting station, the wheel 17 undergoes a 90° rotation in order to transfer it to the second halting station located by the mouth of the guide 31.

This is naturally followed by a fresh pocket 18 being carried to the exit of the channel 20 ready to receive a subsequent piece of candy. The piece of candy that has been transferred is then driven by the pusher member 36 into the guide 31 it is moved along therein.

Figure 6:
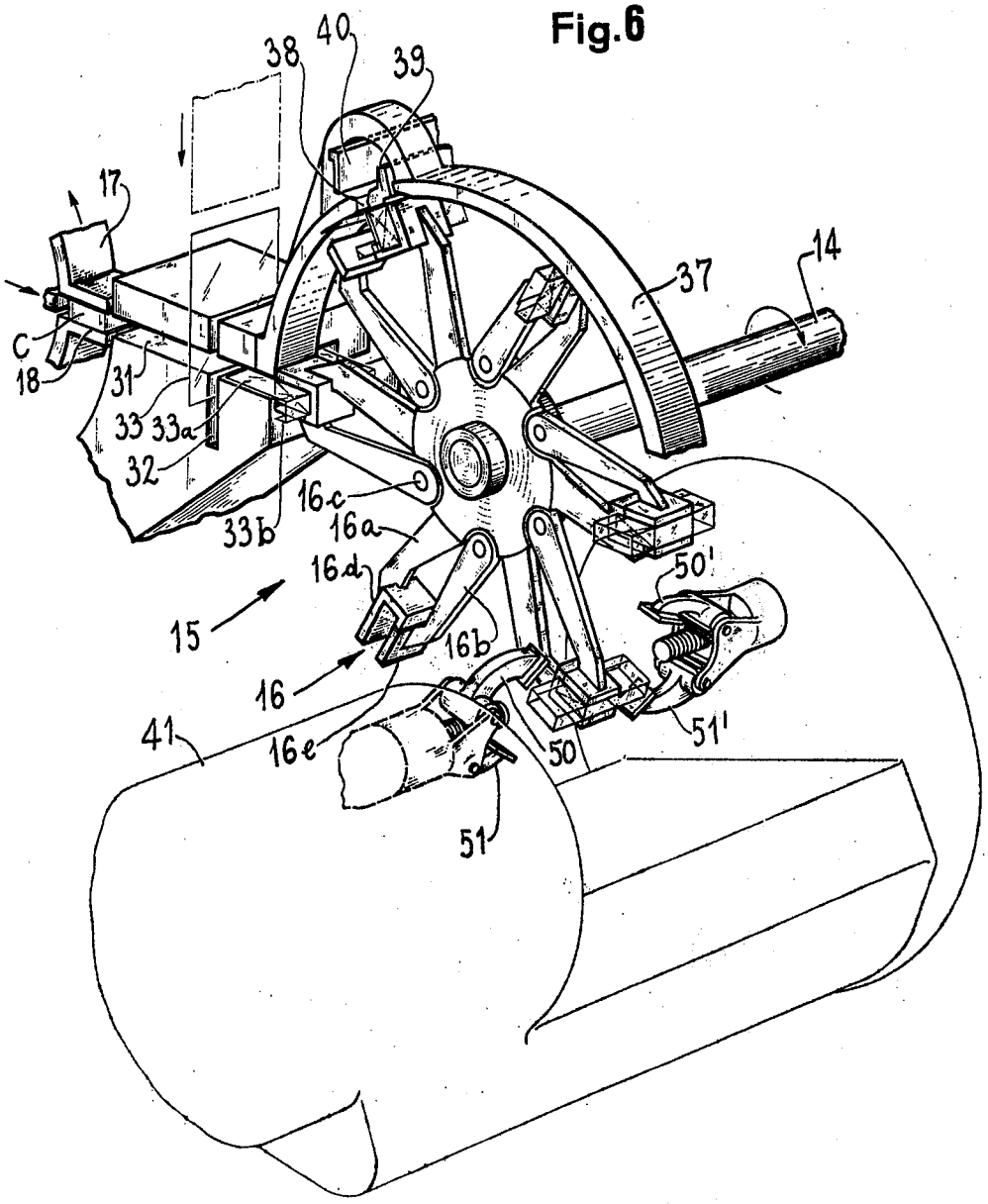
FIG. 6 shows, in a perspective outline, an enlarged detail from FIG. 1.

As it moves (see FIG. 6), the path followed by the piece of candy intersects a cutting of wrapping material 33, for example wax or plasticized paper, previously placed there on a phase relationship basis timed to suit the movement of the succession of pieces of candy via the slit 32 in the guide 31. As the piece of candy moves forward, it sweeps along with it the said cutting of wrapping material which is thus "sucked into" the inside of the guide 31 and is folded into a U with a long flap 33*a* and a short flap 33*b* folded back by the surfaces that delimitate the said guide past the slit 32, as can be seen in FIG. 6. Finally, the piece of candy arrives at a point corresponding to where the particular grippers 16 that are stationary in the first halting station of the wheel 15 are positioned. When in this position, the jaw 16*b* is parted from the jaw 16*a* in order to facilitate the insertion of the piece of candy.

The jaw 16*b* then closes, causing the piece of candy to be gripped therein. The wheel 15 subsequently begins its rotation and as a result of this movement, the flap 33*a* that protrudes from the piece of candy is folded by the leading edge of the profile 37 against the external side of the body of the piece of candy C (see FIG. 6).

The cylindrical profile 37 remains close to the path followed by the side of the piece of candy C and locks the folded flap against the external side.

The transfer of the pieces of candy from the first station to the ejection station takes place with a number of intermediate halts being made and these correspond to the stops the successive grippers make, one after the other, in the first station to allow the successive pieces of candy to be inserted therein.

While one of the intermediate pauses is being made, the presser member 39 and the folding finger 40 operate and complete the wrap in tubular conformation.

Thus the piece of candy, enshrouded in its tubular wrap, arrives at a station where the wrap is completed in, for example, the style known as the 'double end twist' style by means of the twist finger device according to the invention.

The wheel 15, as indicated in FIG. 5, remains at a standstill from 0° to 120° of the machine cycle. The twist fingers 50–51 and 50*a*–51*a* which had previously started to close, at around 315° on the graph in FIG. 5, complete their closing operation at 0° by action of the cam type gear 64, 64*a* which gives the rod 55 and shoulder 55*a* a traversing movement with respect to the sleeve 46, 46*a*. The movement of the rod, by shoulder 55*b*, compresses the spring 63, 63*a*, to shift the rod in the sleeve, pivot the fingers, and thereby grip the wrap by its ends in a releasable way. While the two pairs of fingers rotate along with their respective sleeves because of the pin members 57, 57*a* engaging with the grooves 58, 58*a* and through the gears 45, 45*a* meshing with the toothing 47, 47*a* with which the sleeves 46, 46*a* are provided, the cams 61, 61*a* and 64–64*a* first directly-without any need for lever means cause the fingers to move towards the piece of candy, moving together both the sleeves and the rods relative to the housing and thereby taking account of the wrap having got shorter as a result of its being twisted, see the graph in FIG. 5 from 0° to 115°; thereafter the cams 64–64*a* directly move the rods relative to the sleeves, in the same direction, whereby the fingers open from 115° to 165°. They then return, opened, to their initial position with the sleeve, from 165° to the aforementioned 315° position while the wheel 15 transfers the fully wrapped piece of candy to the ejection station where the jaw 16*b* opens to allow the piece to be extracted.

It has been seen in practice that with the twist finger device according to the invention for fashioning the tubular wrap in the wrapping style known as the 'single end' ('side bow') or 'double end' twist style, the problems experienced to date have been overcome and that when the device is used in conjunction with very high unit output speed wrapping machines producing, for example, around one thousand or more wrapped products per minute, the preset object has been fully attained.

What is claimed is:

1. Apparatus for twisting wrappers on products such as candies, comprising:

a twisting finger device having a carrier for transferring successive products each in a tubular wrapping having an end portion extending beyond the product from one to another part of a wrapping machine and for briefly stationarily presenting the end portion of each wrapper in a predetermined position during the transferring of the products, a housing in the machine opposite said position, a sleeve mounted in the housing for reversible axial sliding toward said position and having gear means on its circumference for driving it in continuous unidirectional rapid rotary motion, a pair of fingers each pivoted to and rotatable with an end portion of the sleeve outside the housing and adjacent said position for reversible pivotal movement of the fingers radially of the sleeve to releasably grip successive ones of the wrapper end portions and for twisting each gripped end portion as the fingers rotate with the sleeve, a rod mounted in the sleeve for rotation therewith and for axial reciprocable sliding both with and relative to the sleeve and having a rod portion projecting from the sleeve in the housing remotely from said position, the rod having another portion outside the housing and adjacent said position for effecting the pivotal movement of the fingers; and drive means for the twisting finger device, comprising;

a. first and second disks in the housing, having hubs mounted respectively on and rotatable relative to the sleeve and the projecting rod portion, each disk having a web rigid with its hub and inclined to the sleeve and rod, defining a cam surface, and having gear teeth on the disk's circumference surrounding the cam surface;

b. first, second and third gear means unidirectionally rapidly rotatable in the housing in synchronism with one another, the first and second gear means engaging the gear teeth of the first and second disks, respectively and the third gear means engaging the gear means on the sleeve, for rapid rotation of the disks and sleeve respectively;

c. first and second roller means stationarily mounted in the housing in contact respectively with the cam surfaces of the first and second disks for axial shifting of the respective disks in response to the rotation thereof;

d. first shoulder means on the sleeve, engageable by the hub of the first disk for direct reversible shifting of the sleeve, fingers and rod, jointly, toward said position, by the first disk; and e. second shoulder means on the projecting rod portion, engageable by the hub of the second disk for direct reversible shifting of the rod relative to the sleeve by the second disk to enable the pivotal movement of the fingers for gripping the wrapper end portions in synchronism with the rapid rotation of the sleeve and fingers for twisting the wrapper end portions.

2. Apparatus according to claim 1 in which the roller means are adjustably stationarily mounted in the housing for adjustment of their contact with the cam surfaces of the disks.

3. Apparatus according to claim 1 wherein each disk web defines a pair of mutually opposite cam surfaces, facing respectively toward and away from said position; each roller means comprising a pair of rollers, in contact with the opposite cam surfaces of the respective pair of such surfaces.

4. Apparatus according to claim 1 in which the first, second and third gear means comprise coaxial first, second and third gears mounted for joint rotation.

5. Apparatus according to claim 1 in which the first, second and third gear means and the respective circumferences with gear teeth are proportioned to produce more than one rotation of the sleeve for each rotation of the disks.

6. Appartus according to claim 1 in which the first shoulder means comprises two shoulders in contant engagement respectively with the two ends of the hub of the first disk.

7. Apparatus according to claim 6 in which the second shoulder means comprises two shoulders spaced apart for alternate engagement by the two ends of the second disk hub.

8. Apparatus according to claim 7 additionally including an axially acting spring mounted on the projecting rod portion between one of the two shoulders of the second shoulder means and the opposite end of the second disk hub.

9. Apparatus according to claim 1 in which the twisting finger device's carrier is enabled to transfer successive products each in a tubular wrapper having first and second, mutually opposite end portions each extending beyond the products; the twisting finger device having symmetrically with said sleeve, rod and pair of fingers, a second sleeve, rod and pair of fingers for gripping and twisting the second wrapper end portion; and second drive means symmetrical with said drive means for the twisting finger device.

10. Apparatus according to claim 9 including a single drive shaft for the gear means of said drive means and of the second drive means.

11. Apparatus according to claim 1 in which the sleeve has a groove longitudinally extending along an inner portion thereof, and the rod has a pin second thereto and slidable along said groove, for the mounting of the rod in the sleeve for rotation therewith and for axial sliding.

* * * * *